US005142983A

United States Patent [19]

Kobler et al.

[11] Patent Number: 5,142,983

[45] Date of Patent: Sep. 1, 1992

[54] SPRING-BIASED SUCTION TRANSFER ACTUATION SYSTEM FOR A MULTI-COLOR SHEET-FED ROTARY PRINTING PRESS

[75] Inventors: Ingo Kobler, Anhausen; Josef Mathes, Offenbach am Main; Robert Ortner, Alzenau, all of Fed. Rep. of Germany

[73] Assignee: Man Roland Druckmaschinen AG, Fed. Rep. of Germany

[21] Appl. No.: 688,726

[22] Filed: Apr. 19, 1991

[30] Foreign Application Priority Data

Apr. 19, 1990 [DE] Fed. Rep. of Germany ..... 4012497

[51] Int. Cl.[5] ..... B41F 1/30

[52] U.S. Cl. ..... 101/409; 101/410; 101/415.1

[58] Field of Search ..... 101/408, 409, 410, 415.1, 101/230-235; 271/275-277, 82, 196, 183-186

[56] References Cited

U.S. PATENT DOCUMENTS

| | | | |
|---|---|---|---|
| 2,080,249 | 5/1937 | Barber | 101/409 |
| 3,937,142 | 2/1976 | Cerny et al. | 101/409 |
| 3,992,993 | 11/1976 | Kuhn et al. | 101/409 |
| 4,029,009 | 6/1977 | Kuhn et al. | 101/409 |
| 4,132,403 | 1/1979 | Weisbach et al. | 271/82 |
| 4,864,929 | 12/1989 | Simeth | 101/409 |
| 5,029,524 | 7/1991 | Wirz et al. | 101/410 |

FOREIGN PATENT DOCUMENTS

| | | | |
|---|---|---|---|
| 1005981 | 4/1957 | Fed. Rep. of Germany | 271/51 |
| 2451987 | 9/1975 | Fed. Rep. of Germany . | |
| 1786371 | 10/1975 | Fed. Rep. of Germany . | |
| 3640805 | 10/1987 | Fed. Rep. of Germany . | |
| 3641439 | 10/1987 | Fed. Rep. of Germany . | |
| 3643915 | 10/1987 | Fed. Rep. of Germany . | |
| 3736808 | 9/1988 | Fed. Rep. of Germany | 101/409 |
| 3608470 | 12/1989 | Fed. Rep. of Germany . | |
| 3926607 | 3/1990 | Fed. Rep. of Germany | 271/277 |
| 2050312 | 1/1981 | United Kingdom | 271/82 |

*Primary Examiner*—Edgar S. Burr
*Assistant Examiner*—Joseph R. Keating
*Attorney, Agent, or Firm*—Leydig, Voit & Mayer

[57] ABSTRACT

A suction transfer actuation system for a transfer drum of a multi-color sheet-fed rotary printing press for turning successive sheets, by rear-edge turning, during the sheet transfer from one printing unit to another to facilitate printing on the back side of the sheets. A plurality of suction arms are rigidly connected to a hollow suction rocker shaft connected to actuating levers carrying a pair of guide rollers engaging a curved outer guide cam surface on a guide bar mounted on the transfer drum. The suction actuation system is driven by way of a cam rigidly mounted on the press frame engaged by a cam follower roller to oscillate a drive lever coupled by a link to a drive arm on the rocker shaft to rock the suction arms toward and away from the one printing unit under the guiding influence of the guide cam and guide rollers. A pair of compression springs disposed substantially at right-angles to one another and radially with respect to the rocker shaft bias the guide rollers against the outer guide cam surface. One end of each compression spring is articulated on the actuating lever and the other end is supported by and bears against the body of the sheet transfer drum.

3 Claims, 7 Drawing Sheets

SPRING-BIASED SUCTION TRANSFER ACTUATION SYSTEM FOR A MULTI-COLOR SHEET-FED ROTARY PRINTING PRESS

FIELD OF THE INVENTION

The present invention relates generally to multi-color sheet-fed rotary printing presses and more particularly concerns a spring-biased suction transfer actuation system for a sheet transfer drum of such presses for turning successive sheets by rear-edge turning during the sheet transfer from one printing unit to another to facilitate printing on the back side of the sheets.

1. Related Application

This application is related to and concerns an improvement in the suction transfer actuation system disclosed in copending application Serial No., 688,042, filed on Apr. 19, 1991, contemporaneously with the filing of this application.

2. Background of the Invention

A suction system for peeling off a sheet from the impression cylinder and transferring the sheet to the first gripper system of a transfer drum is known generally from DE-AS 2,451,987 wherein the suction arms are guided by a transmission system along a trochoidal path with the suction arm ends engaging the rear end of the sheet before the point of tangency between the impression cylinder and the transfer drum and effecting a transfer of the sheet to the first gripper system not later than the point of tangency between the cylinder and drum. However, the time available for engaging and moving the sheet into the transfer position, particularly at high printing press speeds, is so short that guiding the suction arms along the trochoidal path leads to very high acceleration forces and undesirable pivoting angles of the suction arms. Also, errors and imperfections in the surfaces which guide the rocking movement of the suction arms can cause jerking in the transfer of the sheets from the impression cylinder to the first gripper system on the transfer drum.

OBJECTS AND SUMMARY OF THE INVENTION

It is the primary aim of the present invention to provide a spring-biased suction transfer actuation system which enables the rear edge of a sheet on the impression cylinder to be taken over accurately by the suction transfer arms and to be transferred accurately to the first gripper system of the two gripper systems on the transfer drum which oscillate toward and away from one another.

In carrying out the invention, a plurality of suction arms are rigidly connected to a hollow suction rocker shaft connected to actuating levers carrying a pair of guide rollers, spring-biased into engagement with a curved outer guide cam surface on a guide bar mounted on the transfer drum. The suction actuation system is driven by way of a cam rigidly mounted on the press frame engaged by a cam follower roller to oscillate a drive lever coupled by a link to a drive arm on the rocker shaft to rock the suction arms toward and away from the impression cylinder under the guiding influence of the guide cam and guide rollers. In the preferred embodiment, a pair of compression springs bias the cam rollers against the curved outer guide cam surface and the springs are pivotally connected at one end to the actuating lever generally at right angles to one another and substantially radially with respect to the rocker shaft. The outer ends of the springs are secured and supported by the body of the transfer drum.

The arrangement of the suction actuation system of the present invention enables the suction surfaces on the suction arms to tangentially engage the rear edge of a sheet on the impression cylinder well in advance of the tangency point between the impression cylinder and the transfer drum. After the sheet has been engaged by the suction surfaces of the suction arms, the spring-biased guide cam rollers guided on the outer guide cam surface cause the suction arms to draw the sheet over a prolonged distance and below the outer periphery of the transfer drum still in advance of the tangency point between the cylinder and drum and thereby avoid creating a detrimental o excessive angle between the suction surfaces of the suction arms and the sheet as the sheet is transferred to the first gripper system of the transfer drum. The first gripper system on the transfer drum then performs its pivoting rear-edge sheet turning movement independently of the rocking movement of the suction transfer actuation arms.

The disposition of the compression springs and their biasing force on the guide rollers helps to compensate for errors and irregularities in the surface of the outer guide cam and also substantially reduces jerking movements in the transfer of sheets by the suction arms from the impression cylinder to the first gripper system on the transfer drum.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
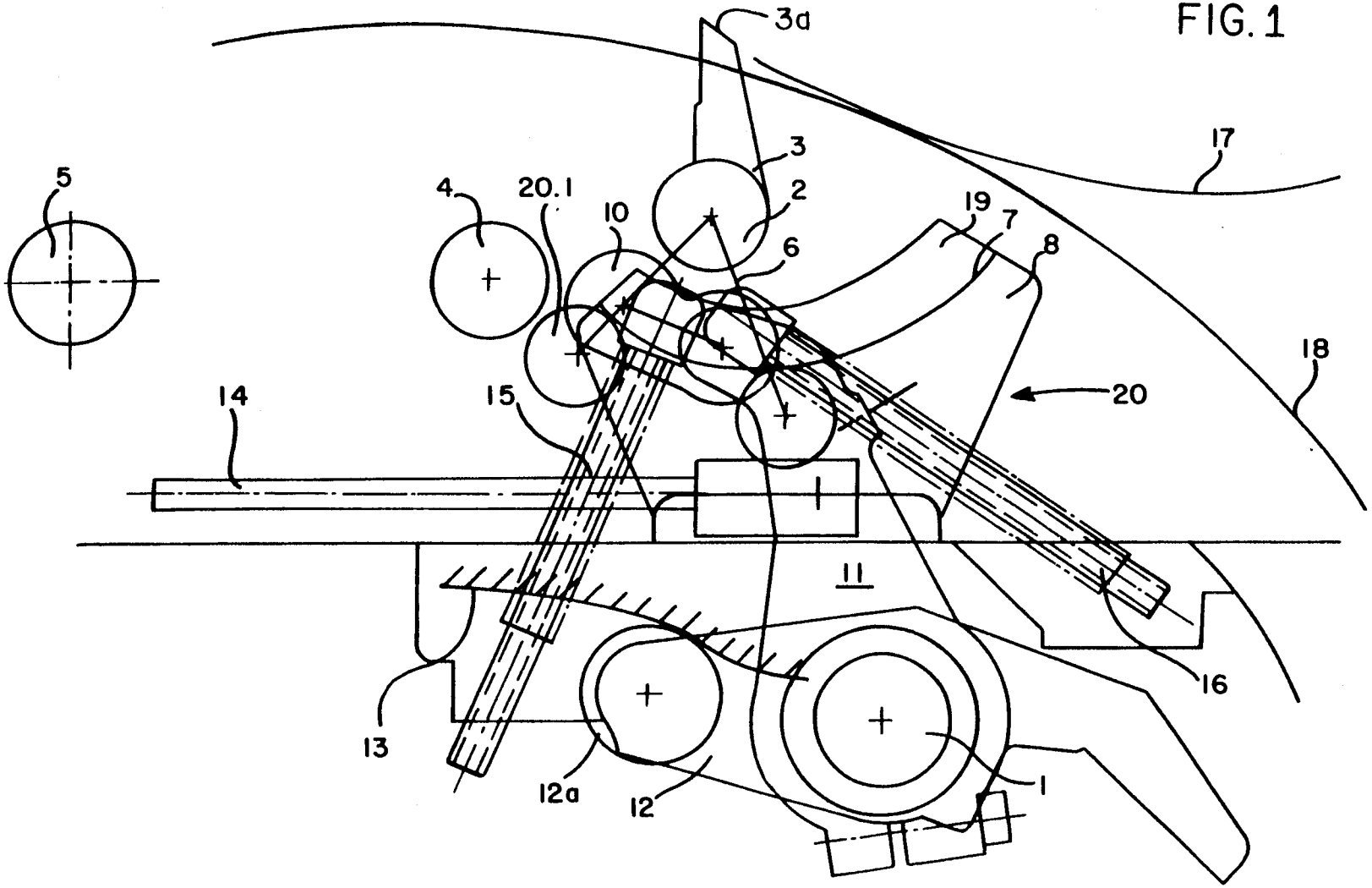
FIG. 1 is a partial sectional view through a sheet transfer drum of a rotary printing press including the spring-biased suction transfer actuation system of the present invention with the suction transfer arms shown in the phase wherein the rear end of a sheet on the impression cylinder is engaged by the suction surface of the transfer arms.

Turning now to the drawings, FIG. 1 shows a portion of a multi-color sheet-fed rotary printing press including a sheet transfer drum 18 and an impression cylinder 17 in the phase where a sheet (not shown) is peeled away from the impression cylinder by the suction transfer system 20 of the present invention. Briefly and as only schematically shown here, the suction surface 3*a* of one of a plurality of suction transfer arms 3 engages the rear end of a sheet and transfers it to the first gripper system 4 disposed on the transfer drum 18. Further details of this aspect of the sheet transfer are disclosed in the above-mentioned copending application which is incorporated herein by reference. It will also be understood by reference to that application that the first gripper system 4 pivots or rocks toward (and away from) a second rocking gripper system 5 and transfers the rear end of the sheet to it. Pivotal or rocking movement of the second gripper system 5 away from the first gripper system turns the sheet over by rear-edge turning and presents it to the grippers on a second impression cylinder (not shown) so that the back side of the sheet may be printed, as is conventional in presses of this kind.

Figure 2:
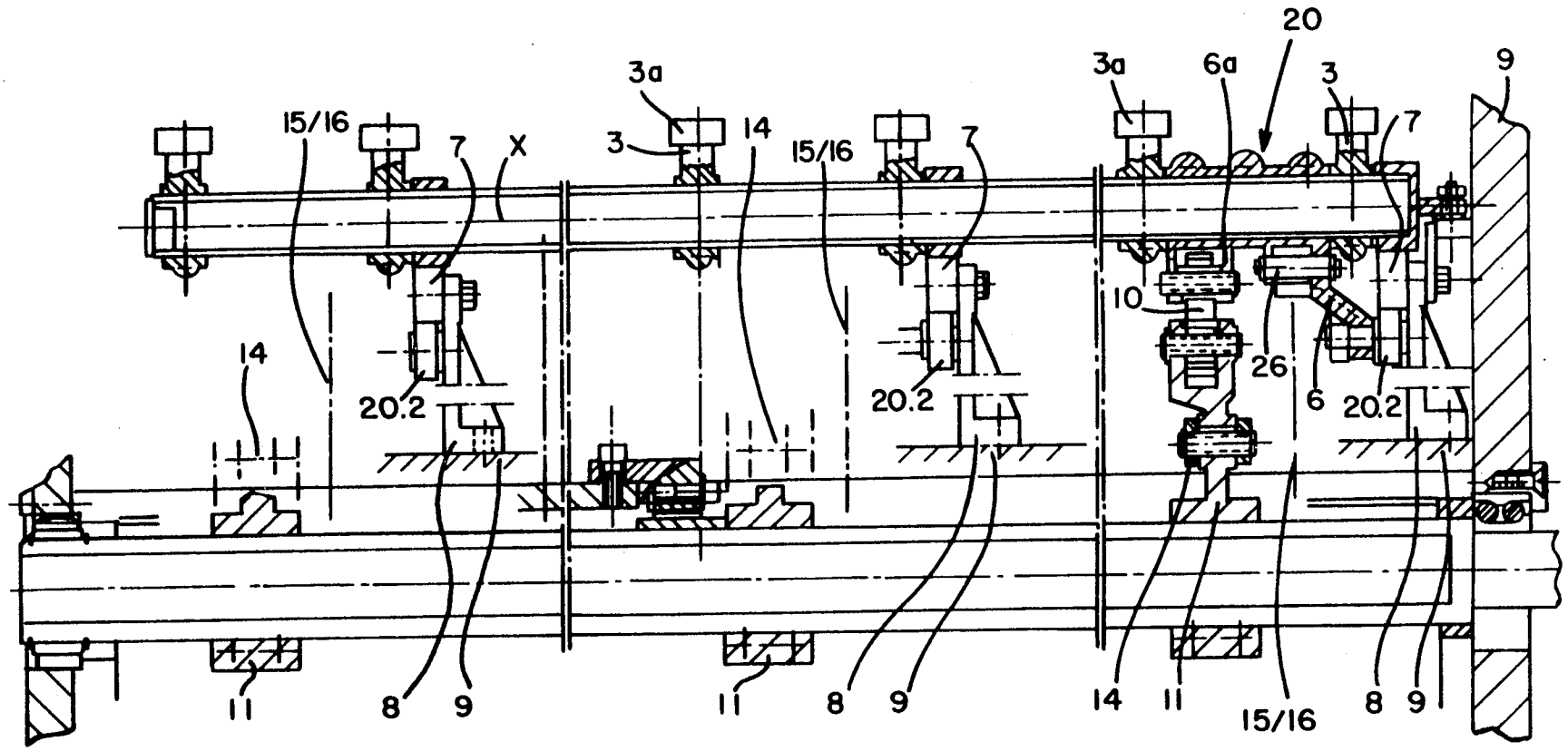
FIG. 2 is a fragmentary plan view, partly in diagrammatic form, of the spring-biased suction transfer actuation system shown in FIG. 1.

As is more clearly shown in FIG. 2, the suction transfer arms 3 of the suction transfer system 20 are rigidly connected to a hollow suction rocker shaft 2 which is also rigidly connected to actuating levers 6, only one of which is shown. In the preferred embodiment, each of the actuating levers 6 carries a pair of outer guide cam rollers 20.1 and 20.2.

To control the movement of the axis X of the rocker shaft 2, guide bars 19 are rigidly connected to brackets 8 mounted on the inner body 9 of the transfer drum 18, as shown in FIG. 2. The guide bars 19 are arcuate shaped and are provided with a curved outer cam surface 7 against which the outer guide rollers 20.1 and 20.2 are engaged for rolling movement.

Figure 3:
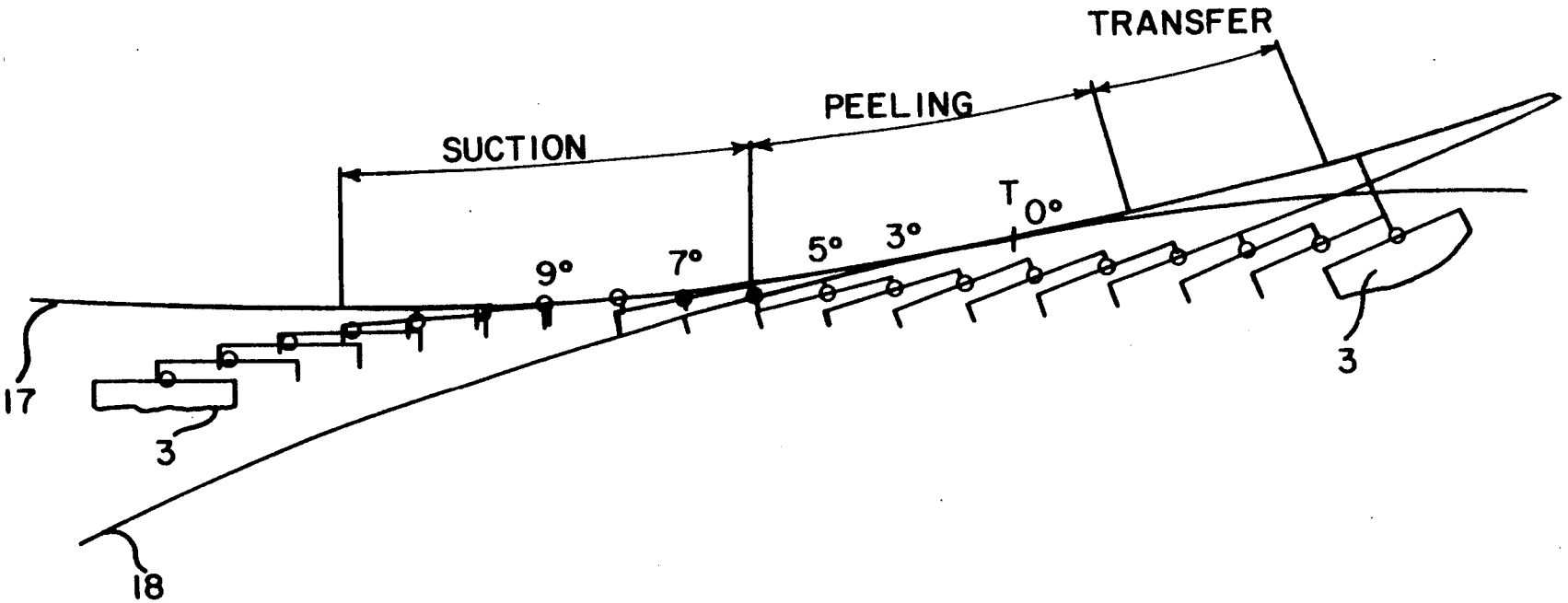
FIG. 3 is a schematic side view of the path of the suction surface of one of the suction transfer arms as it engages the rear end of a sheet on the impression cylinder and peels the sheet away from the impression cylinder.

As the hollow suction shaft 2 is rocked by the drive mechanism to be hereinafter described, the guide cam rollers 20.1 and 20.2 and curved outer guide cam surface 7 produce a movement pattern enabling the suction surfaces 3*a* of the suction arms 3 secured to the suction shaft 2 to move along a path as shown schematically in detail in FIG. 3. In a first phase, labeled "Suction" in FIG. 3, the suction surfaces 3*a* engage the rear edge of a sheet on the periphery of the impression cylinder 17 and move over an elongated path adjacent the periphery at the same speed as the impression cylinder. In a second phase, labeled "Peeling," the suction surfaces 3*a* are moved below the periphery of the transfer drum 18 before the tangency point T of the drum 18 and cylinder 17. Since the sheet is retained rigidly by the suction surfaces 3*a*, the sheet is peeled off the impression cylinder 17 as the suction surfaces 3*a* follow along a modified involute path in a moving coordinate system of the rotating transfer drum 18 and the impression cylinder 17. In the third and final phase, labeled "Transfer," the suction surfaces 3*a* transfer the rear edge of the sheet to the first gripper system 4 (not shown in FIG. 3) without any appreciable alteration in the deflection angle between the suction surfaces 3*a* and the sheet.

The foregoing path control provided by the suction transfer actuation system 20 of the present invention ensures that the sheet is engaged reliably and allows space for the introduction of the finger of the first gripper system 4. It will be understood that the gripper finger moves, in a known manner, not described further herein, toward the sheet resting on the suction surfaces 3*a*. Because the cam guide bars 19 are rigidly secured to the transfer drum 18 there is essentially no possibility of relative displacement occurring between the drum 18 and the cam surfaces 7, even after a prolonged period of operation.

Figure 4:
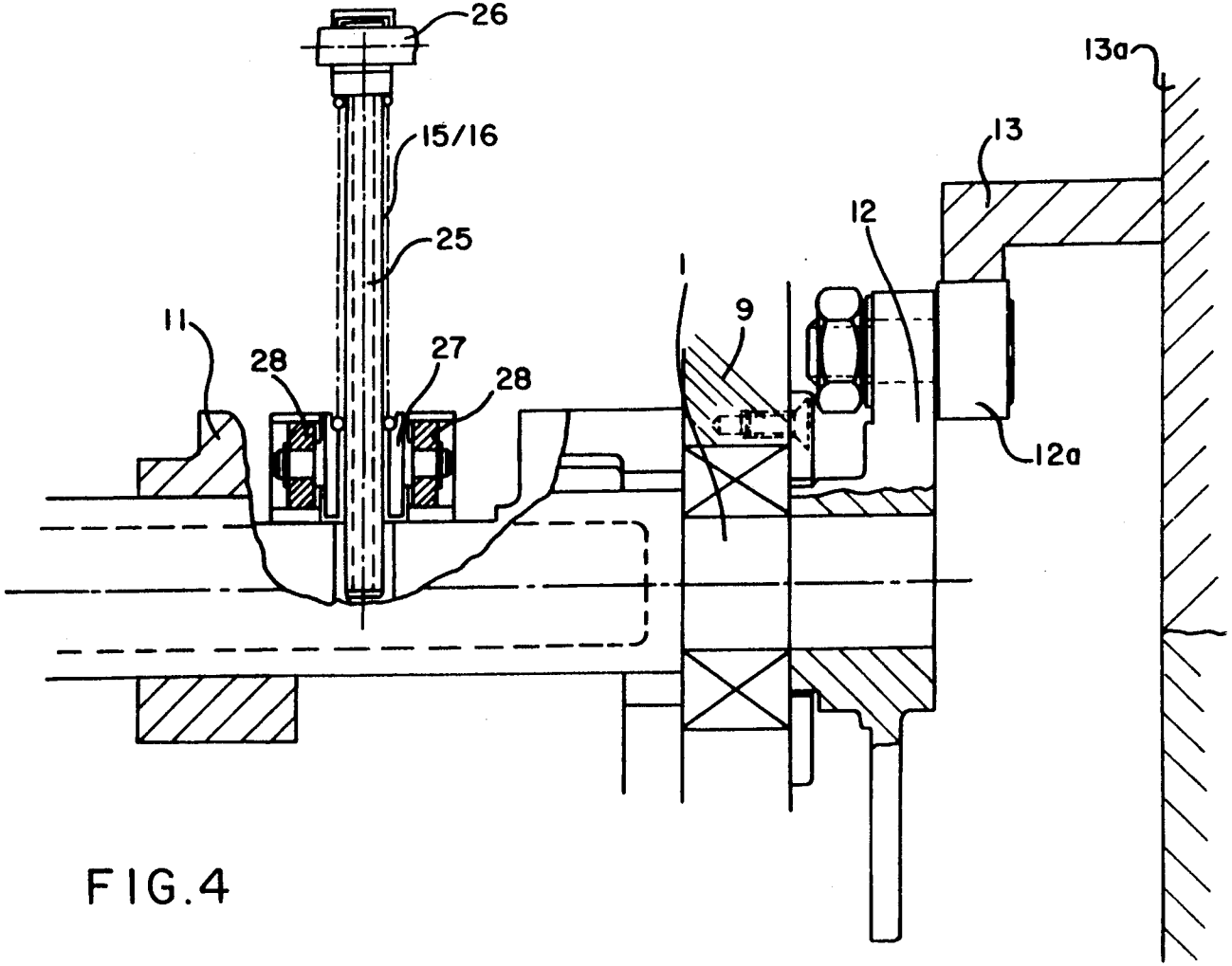
FIG. 4 is an enlarged, fragmentary view, partly in section of a portion of the drive cam, the drive shaft and the mounting of one of the compression springs of the suction transfer actuation system shown in FIG. 1.

To drive the suction transfer actuation system 20 of the present invention, a drive cam 13 is rigidly secured to the press frame 13*a* A drive lever 11 is secured to a drive shaft 1 rotatably mounted in the transfer drum 18 and is pivotally connected by a connecting link 10 to a drive arm 6*a* secured to the hollow suction rocker shaft 2. A cam follower lever 12 is rigidly connected at one end to the drive shaft 1 and carries a cam follower roller 12*a* which engages and rolls on the camming surface of the drive cam 13 to produce an oscillating movement to the drive shaft 1 and drive lever 11. This oscillating movement of the drive lever 11 is communicated by the connecting link 10 and drive arm 6*a* to the suction rocker shaft 2 which is rocked back and forth under the influence of the guide cam rollers 20.1 and 20.2 rolling on the guide cam surface 7 of the guide bar 19. Preferably both the lever 11 and the guide bar 19 with holder 8 are provided on both sides of the sheet transfer drum 18 and between the sides on the drum body 9. The roller of the lever 12 is maintained in engagement with the camming part of the cam 13 by means of a spring 14 acting by way of the lever 11 and drive shaft 1. As shown in FIG. 1, the spring 14 is mounted on a supporting slide rod 14*a* pivotally connected at one end to the lever 11 by a pivot block 14*b* and slidably supported at the other end by a slide block 14*c* secured to the drum body. In FIG. 4, a portion of the drive cam follower lever 12 is shown carrying the cam follower roller 12*a* engaging the camming surface of the drive cam 13 rigidly secured to the press frame 13*a*.

In accordance with the present invention, and to reduce and compensate for jerking in the rear-edge takeover of the sheet on the impression cylinder 17 by the pivotal suction transfer actuation system 20 and in the transfer of the sheet by means of the rockable suction arm 3 to the first gripper system 4, the guide cam rollers 20.1 and 20.1 are spring-biased into engagement with the outer cam surface 7 on the guide bar 19. Preferably, two compression springs 15 and 16 are provided which extend substantially radially with respect to the rocker shaft 2, and the springs 15, 16 are disposed substantially at right angles to one another.

In the illustrated embodiment, each of the compression springs 15, 16 is mounted concentrically on a center slide rod 25 which is connected at one end by an articulated joint or pivot pin 26 to the actuating lever 6. The other end of the slide rod 25 is received in the bore of a slide block 27 pivotally mounted on supporting webs 28 secured to the inner body 9 of the transfer drum 18. As shown in FIG. 4, each of the compression springs 15, 16 is mounted on its slide rod 25 so as to exert a biasing force between the pivot joint 26 and the slide block 27. The compression springs 15, 16 urge the guide rollers 20.1, 20.2 into engagement with the curved outer cam surface 7 of the guide bar 7 and also boost the rolling of the guide rollers on the cam surface.

Figure 5:
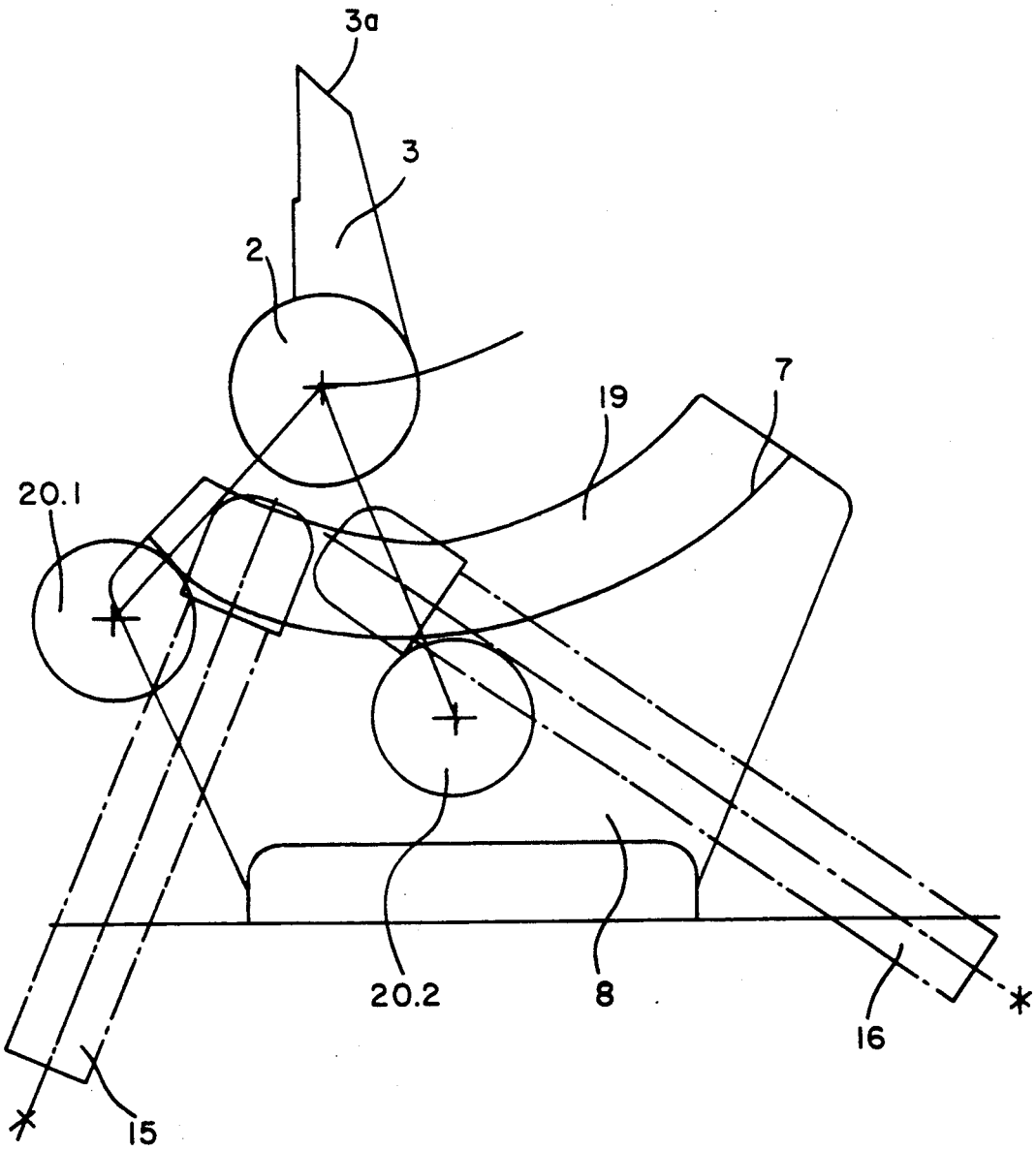
FIGS. 5, 6 and 7 are schematic side views of the spring-biased guide rollers and compression springs illustrating their orientation in three different phases in the movement of the suction rocker arms.
Figure 6:
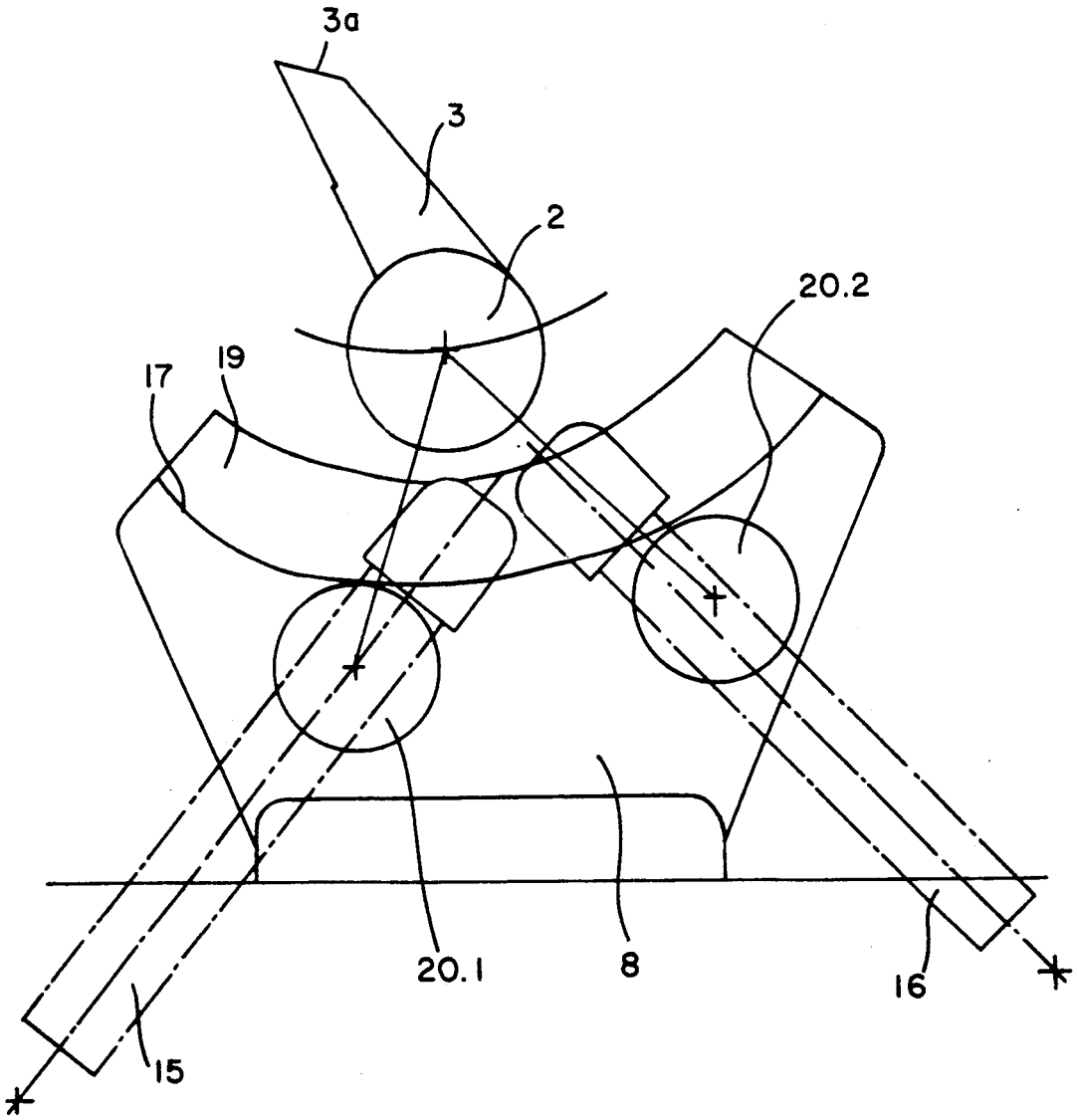
Figure 7:
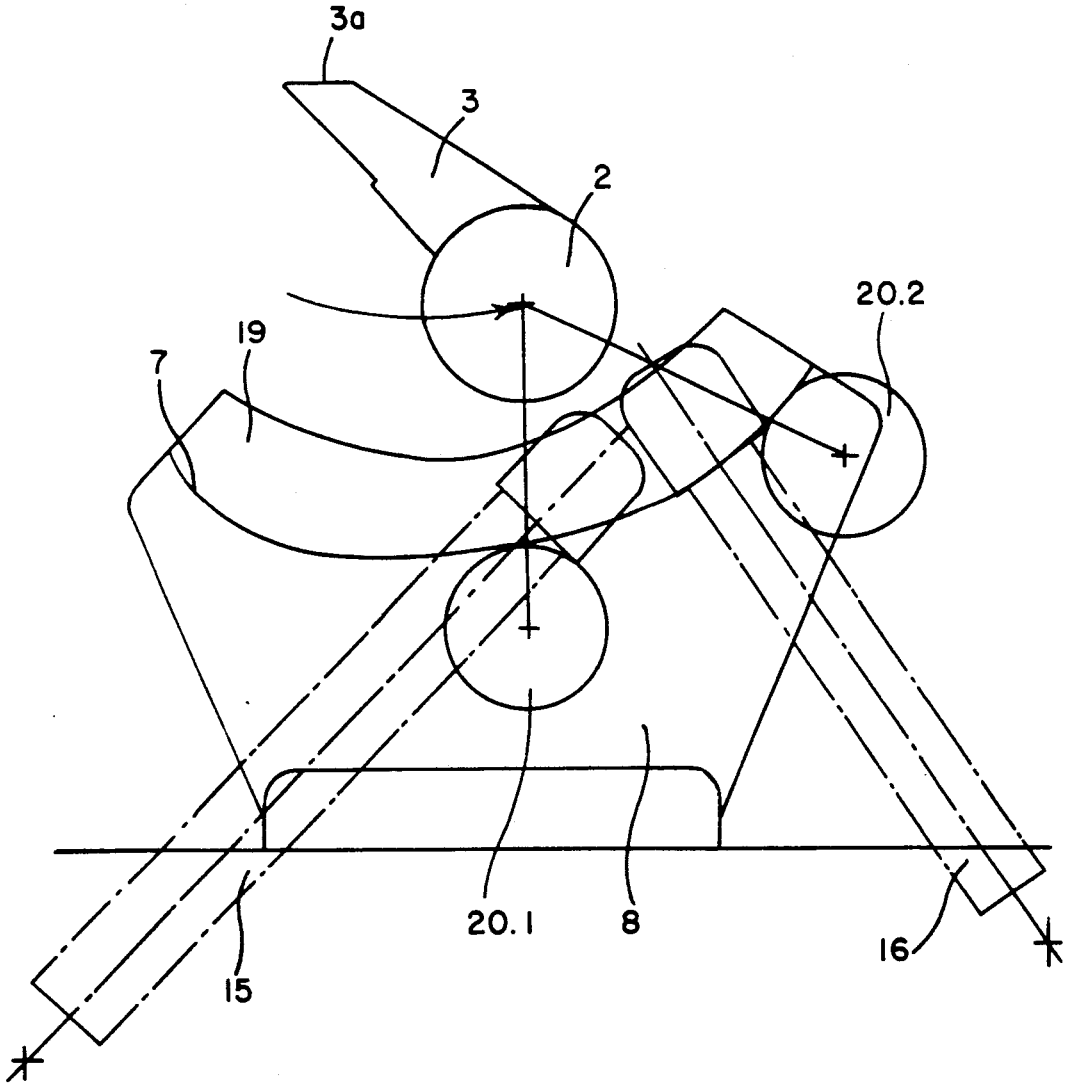

The different dispositions of the guide rollers 20.1, 20.1 and compression springs 15, 16 during the different phases of rocking movement of the suction arm 3 are schematically illustrated in FIGS. 5–7. Referring first to FIG. 5, the compression spring 15 is in a stressed state in the phase, corresponding to the "Suction" phase in FIG. 1, in which the sheet is taken over from the impression cylinder 17 whereas the compression spring 16 is unstressed. Jerking on the impression cylinder is therefore reduced by the suction transfer actuation system 20 of the present invention. Also, the compression spring 15 boosts acceleration of the suction transfer actuation system 20 in the direction of movement to the right in FIG. 5.

Referring next to FIG. 6, at approximately half the rocking travel of the pivotable suction transfer actuation system 20, which occurs during the "Peeling" phase illustrated in FIG. 1, the two springs 15, 16 are in a state of equal stress to one another. The moving suction actuation system is in a phase in which a reversal of acceleration occurs. In this phase the spring forces provided by the springs 15, 16 provide neither acceleration nor retardation.

Finally, referring to FIG. 7, the compression spring 15 is in the destressed state during the phase, corresponding to the "Transfer" phase in FIG. 1, in which the sheet is transferred from the suction transfer actuation system 20 to the first gripper system 4, whereas the spring 16 is in a stressed state. Consequently, by retardation of the movement a shock-free engagement of the suction transfer actuation system with the stops (not shown) for determining the position of the rear edge of the sheet for transfer to the first gripper system 4 is achieved; the spring 16 boosting retardation of the suction transfer system. In the return movement from the transfer position to the takeover position the pattern of spring movement and stress conditions reverses correspondingly.

The drawings do not show that the sheet is finally clamped on the gripper supports of the first gripper system 4 by gripper fingers thereof, the suction arms 3 performing their pivoting movement, as previously stated, until engaging stops (not shown) of the first gripper system 4 in order to determine the position of the rear edge of the sheet in known manner.

Also in known manner the first gripper system 4 transfers to a second gripper system 5 not shown in detail in the drawings, whereafter a transfer is made to the gripper system of the next impression cylinder (not shown). This kind of sheet turning is known and is illustrated and described in detail in DE-PS 1,786,371.

We claim as our invention:

1. A suction transfer actuation system for a multicolor sheet-fed rotary printing press having a press frame, first and second printing units and a sheet transfer drum including first and second gripper means disposed thereon, said suction transfer actuation system comprising, in combination, a plurality of hollow suction arms disposed on said transfer drum ahead of said first gripper means, said suction arms having proximate and distal ends, rocker means including a hollow suction rocker shaft disposed on said transfer drum for rigidly supporting the proximate ends of said suction arms and for rocking the distal ends of said suction arms toward and away from the first printing unit, at least one actuating lever rigidly connected at one end to said rocker shaft, a guide rail defining a curved outer guide cam surface mounted on the transfer drum, roller means including a pair of guide rollers mounted on the other end of said actuating lever for rolling engagement with said outer guide cam surface, drive means including a drive cam rigidly mounted on the press frame, a drive lever pivotally disposed on the transfer drum, and follower means including a cam follower roller engageable with said drive cam for oscillating said drive lever so as to rock said hollow suction rocker shaft and said distal ends of said suction arms toward and away from the first printing unit under the guiding influence of said outer guide cam surface and said guide rollers, means including a pair of compression springs for biasing said guide rollers against said outer guide cam surface, support means for securing each spring so that one end thereof bears on said actuating lever and the other end thereof bears against the body of said sheet transfer drum, and said pair of compression springs being disposed substantially at right-angles to one another and substantially radially with respect to said hollow suction rocker shaft.

2. A suction transfer actuation system as defined in claim 1 wherein said support means includes a slide rod for supporting each of said compression springs, a pivot joint connecting one end of said slide rod to said actuating lever, a slide block pivotally connected to said drum body for slidably receiving said slide rod therein, and said compression spring being mounted on said slide rod so as to exert a biasing force between said pivot joint and said slide block.

3. A suction transfer actuation system as defined in claim 1 including a pair each of said guide rails, actuating levers, drive cams and drive levers, one of each pair being mounted adjacent each end of said transfer drum.

* * * * *